United States Patent [19]

Mathieu et al.

[11] 4,127,007

[45] Nov. 28, 1978

[54] INSTALLATION FOR RELEASING SUBMERGED FLOATS

[75] Inventors: Francis D. A. Mathieu, Nogent sur Marne; Edmond Saintenoy, Paris, both of France

[73] Assignee: Compagnie Generale pour les Developpements Operationnels des Richesses Sous-Marines "C.G. Doris", Paris, France

[21] Appl. No.: 779,022

[22] Filed: Mar. 14, 1977

[30] Foreign Application Priority Data

Mar. 18, 1976 [FR] France ..... 76 07906
Dec. 23, 1976 [FR] France ..... 76 38900

[51] Int. Cl.[2] ..... F16L 1/00; F16L 3/00
[52] U.S. Cl. ..... 405/171
[58] Field of Search ..... 61/112, 105–110; 9/8 R; 114/270, 293

[56] References Cited

U.S. PATENT DOCUMENTS

| | | | |
|---|---|---|---|
| 3,128,512 | 4/1964 | Moulton | 9/8 R X |
| 3,594,835 | 7/1971 | Wilson | 9/8 R |
| 3,620,028 | 11/1971 | Wilde | 61/112 |
| 3,722,014 | 3/1973 | Hill et al. | 9/8 R |
| 3,727,417 | 4/1973 | Shaw | 61/112 |
| 3,934,288 | 1/1976 | Kirkland | 9/8 R |
| 3,947,907 | 4/1976 | Synodis | 9/8 R |
| 4,011,729 | 3/1977 | Kermel | 61/112 |
| 4,033,277 | 7/1977 | Schaper | 114/293 |

*Primary Examiner*—Dennis L. Taylor
*Attorney, Agent, or Firm*—Laurence R. Brown

[57] ABSTRACT

An installation for the release of floats supporting by individual cables a structure submerged in an aqueous medium, comprising attachment means fixed on the structure and co-operating with one end of said cable, the other end carrying the float, liberating means co-operating with said attachment means, and a control station for said liberating means, wherein the first of said liberating means is connected to a principal control line connected to the control station, the subsequent liberating means being connected together in such manner that they are automatically and successively actuated after said first liberating means has been actuated via the principal control line, the principal control line and the connections between successive liberating means consisting of fluid pressure lines or electric cables.

18 Claims, 6 Drawing Figures

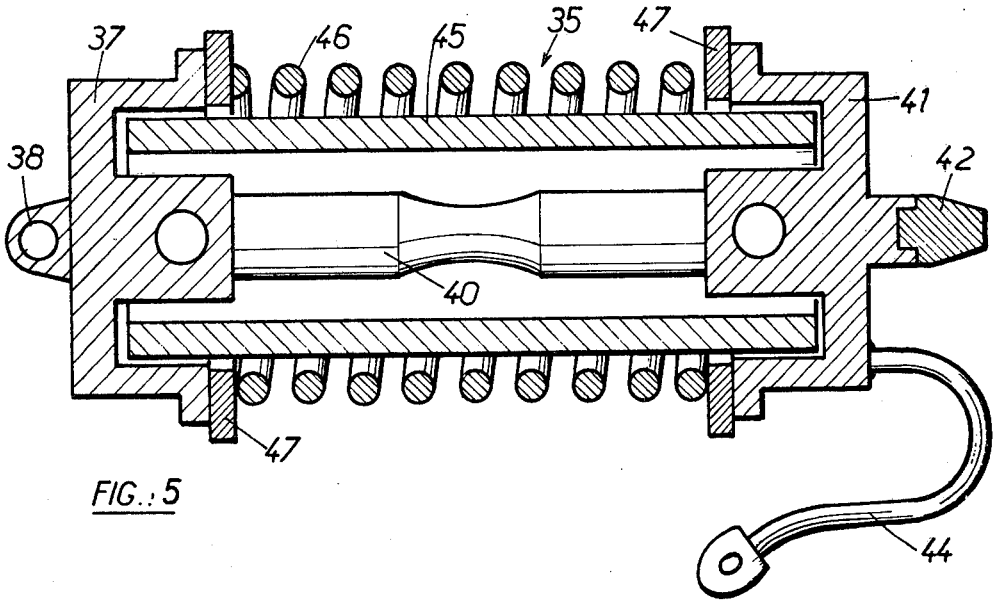
FIG. 5
FIG. 6
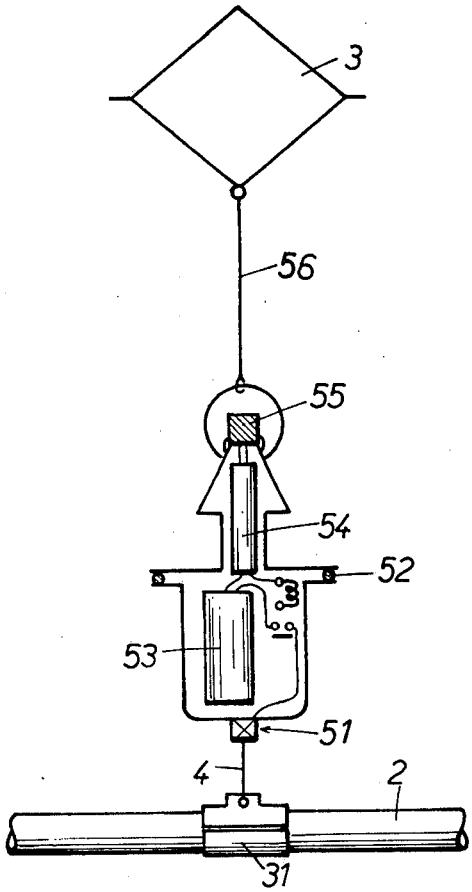

INSTALLATION FOR RELEASING SUBMERGED FLOATS

The present invention is concerned with petroleum wells (exploitation of petroleum under the sea) and more specifically relates to an installation for releasing floats which are submerged in an aqueous medium. Although the solution of the invention can be applied to laying any structure on the earth floor of an aqueous medium, and in particular on the bed of the sea, one is here considering more especially, by way of example, the problem of laying pipelines on the bed for connecting a petroleum well or storage station to the shore.

Up until now, such a structure, i.e. such a pipeline, is suspended from a series of floats, brought to the desired location and loaded with chains which cause it to sink. The pipeline descends at the chosen location until the chains come into contact with the ground which gives partial support until the pipeline comes to equilibrium a short distance above the ground. Then, divers are sent down to cut successively the cables of the floats, thereby causing the pipeline, which is relatively flexible, to contact the bed vertically at the various successive release points.

This procedure is dangerous for the divers, who risk being injured by the cables when they are broken. Furthermore, it is rather inconvenient and lengthy and cannot be applied at too great depths. A submarine could be used for this operation but it is clear that this would be an enormous complication.

The invention seeks to provide a simple solution to this problem by establishing a simple and rapid handling control. To this effect, briefly use is made of a telecontrol network for releasing the different cables, and corresponding floats; more precisely, the installation according to the invention comprises a remote control station, liberating means one by one of the cables, near to each of said cables, principal control connecting means linking the control station to one of said liberating means for releasing a cable and corresponding float, and a series of intermediate control connecting means linking each of said liberating means to the following means, arranged so as to release the following cable and float after each liberation of a cable.

According to another aspect of the invention, the intermediate connecting means are coupled to the principal control connecting means so as to permit the liberation of the following cable, after each release of cable and float, as a result of the control from the control station.

Nevertheless, in the different embodiments of the invention, it is necessary to ensure that, if one of the liberating means is accidentally blocked, the other succeeding liberating means, placed dependent upon it, are not also blocked, which would prevent the release of all the corresponding floats. For this reason, the installation of the invention advantageously comprises security means so arranged that in the case of local malfunctioning causing the non-release of a cable and float, the strengthening of the control action nevertheless brings about the liberation of the following cable. Or, to the same end, the installation may comprise two intermediate connecting means assemblies in parallel to ensure with greater certainty the liberation of successive cables.

According to different embodiments, the release control can be effected with the aid of fluid pressure devices, preferably hydraulic, or electrical actuating devices.

A more complete appreciation of the invention and many of the attendant advantages thereof will be readily appreciated as the same becomes better understood by reference to the following detailed description when considered in connection with the accompanying drawings in which like reference characters designate identical or corresponding parts throughout the several views and wherein:

FIG. 5 shows, in section, a liberating means actuated electrically.

FIG. 6 illustrates an embodiment of the safety device, said device comprising an explosive bolt.

Figure 1:
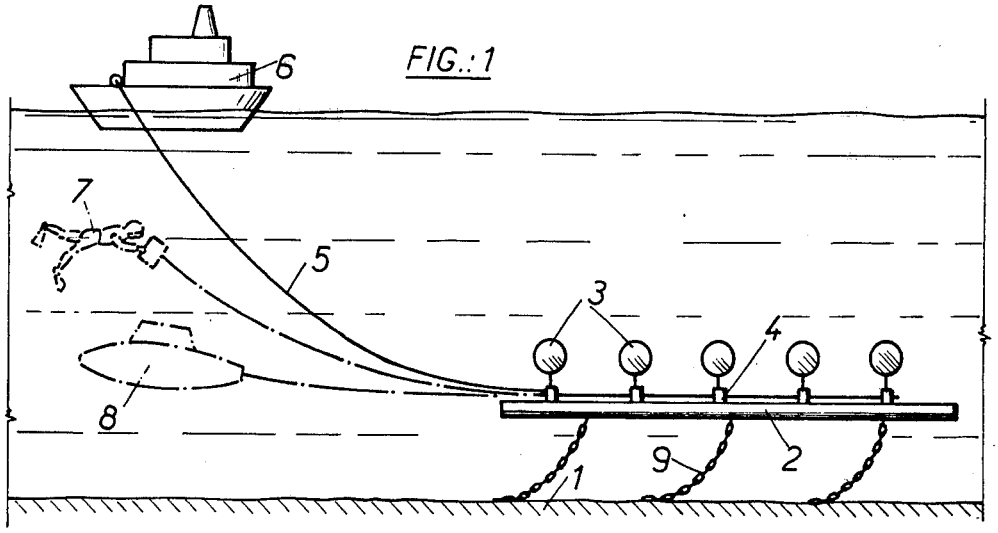
FIG. 1 shows the assembly of an installation according to the invention.

FIG. 1 shows a fixed structure 2, a tube or pipeline for example, suspended from floats and maintained near the bed by means of chains 9. A series of floats 3 is connected to the fixed structure 2 by attachments 4. The successive release of the floats can be controlled by means of an hydraulic or electrical control 5 called principal control connecting means and consisting according to the various embodiments of a hydraulic tube or electric cable attached to a point of the structure, for example at its end. The other end of the hydraulic tube is connected to a conventional control means which may be located, for example, at a control station on a boat 6. Alternatively, it could be at the disposal of a diver 7 or connected to a submarine 8, or to any other fixed or mobile installation, remotely situated. The control station can thus be located on the surface of or in the water.

Figure 2:
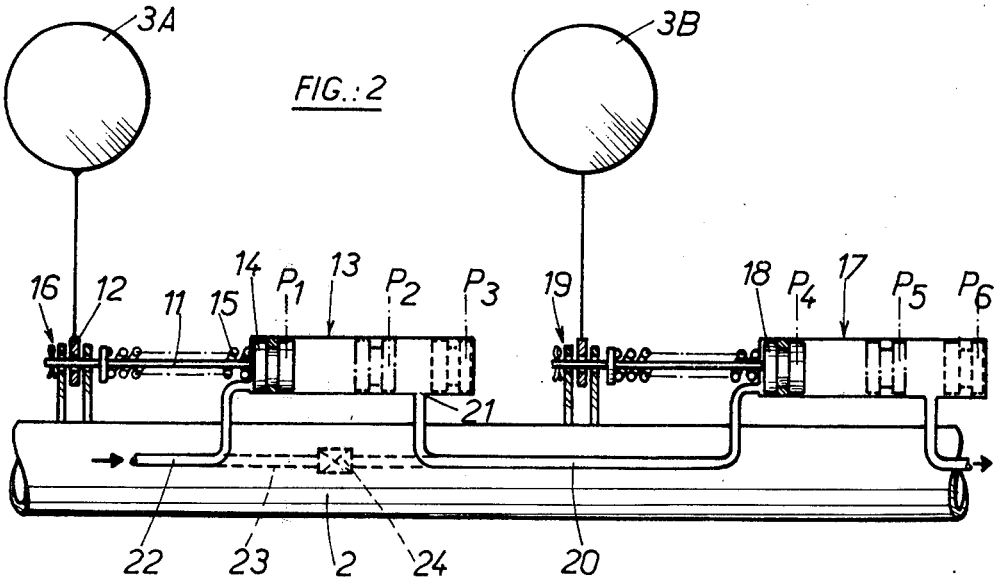
FIG. 2 shows a series of liberating means for the floats according to a first embodiment, the liberating means being actuated by a fluid.

According to the example of FIG. 2, the liberating means of the floats by releasing the corresponding cables are all preferably identical. The principle of liberation will be explained with reference to FIG. 2 which shows two successive floats 3A and 3B. First to be consider will be the liberating means of the float 3A, said means being formed of two parts, a first part 13 and a second part 11.

The attachment of the float 3A is effected by the stem 11 of a piston 14 of a jack 13, said stem passing through the attachment means 4 consisting in this example of lugs fixed to the structure and a ring 12 fixed to the end of the cable. The jack 13 is controlled hydraulically by the application through the pipe 22, at its left end, of an hydraulic pressure opposed to the action of a spring 15, so as to withdraw and displace the stem 11 until it liberates the float 3A. To this effect, the cable of the float 3A has at its end a ring 12 which is threaded on to the end of the piston stem 11 and it is clear, from FIG. 2, that when the piston 14 passes from the position P1, at the left extremity, to the position P2, sufficiently central, the float 3A will be released.

The pressure fluid continuing to be delivered through the pipe 22, the piston continues to move towards the right and reaches a position P3, where the inlet orifice of the pipe 20, similar to the pipe 22, but for the following jack 17, is uncovered and supplied; this other jack is in turn supplied and the float 3B is then released in the same manner as the float 3A, and so on. The piston acts as commutation means between the two intermediate connecting means 20 and 22.

It will be understood that the supply of control fluid to the jacks can be controlled so as to clearly provide successive pauses between the release of the different floats.

The springs such as 15 serve to keep the pistons in pressure on the control fluid during the release manoeuvre. Furthermore, security pins, such as 16 and 19, are provided to avoid any uncontrolled untimely release; this pin will be sheared by the force of the cylinder upon release.

In carrying out the invention, it is important to ensure, as far as possible, that if a float cannot be released — for example because of seizure of one of the jack pistons — the following floats are not also blocked without being able to be released. To avoid this inconvenience, a safety device is provided for example for the float 3A, a by-pass pipe 23, in which is mounted a valve 24 actuated, for example, at three times the normal operating pressure of the jack. It follows that, if the piston 14 refuses to move, the pressure continues to increase and when it reaches the operating pressure of the valve 24, it will be possible to feed the following jack 17 through the by-pass pipe 23 and the following float 3B will then be released.

According to another possible solution with the same object, the intermediate connecting means between the release means could be duplicated and branched in parallel on the release means.

Before service, the cylinders may be full of air, but in that case they must be able to withstand the pressure of the water.

Figure 3:
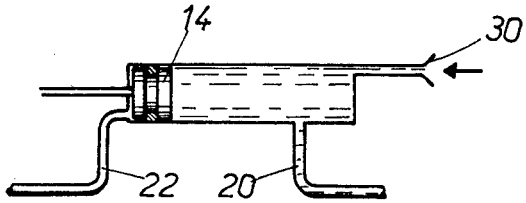
FIG. 3 is a modification of the liberating means which is actuated hydraulically.

Another solution according to the invention, more advantageous, consists in filling them with a fluid, which could be water put under equal pressure by means of a membrane (not shown) or by direct communication at 30 with the ambient water, as shown in FIG. 3.

Another particular advantage of the invention consists in that the control can be effected, as has been explained, by a single hydraulic tube. Nevertheless, the invention does not exclude, it will be understood, the possibility of having several hydraulic control tubes.

Another possibility consists in placing a fluid pressure injection pump on the submerged structure and in controlling this pump from a control board by means of an electric cable for the remote control of the operations. In this case, the hydraulic fluid for use can be supplied from a submerged reservoir situated near the structure, or on the surface (by the side of a boat), for example by means of a tube, or this could be the ambient water taken directly from the vicinity of the pump.

Figure 4:
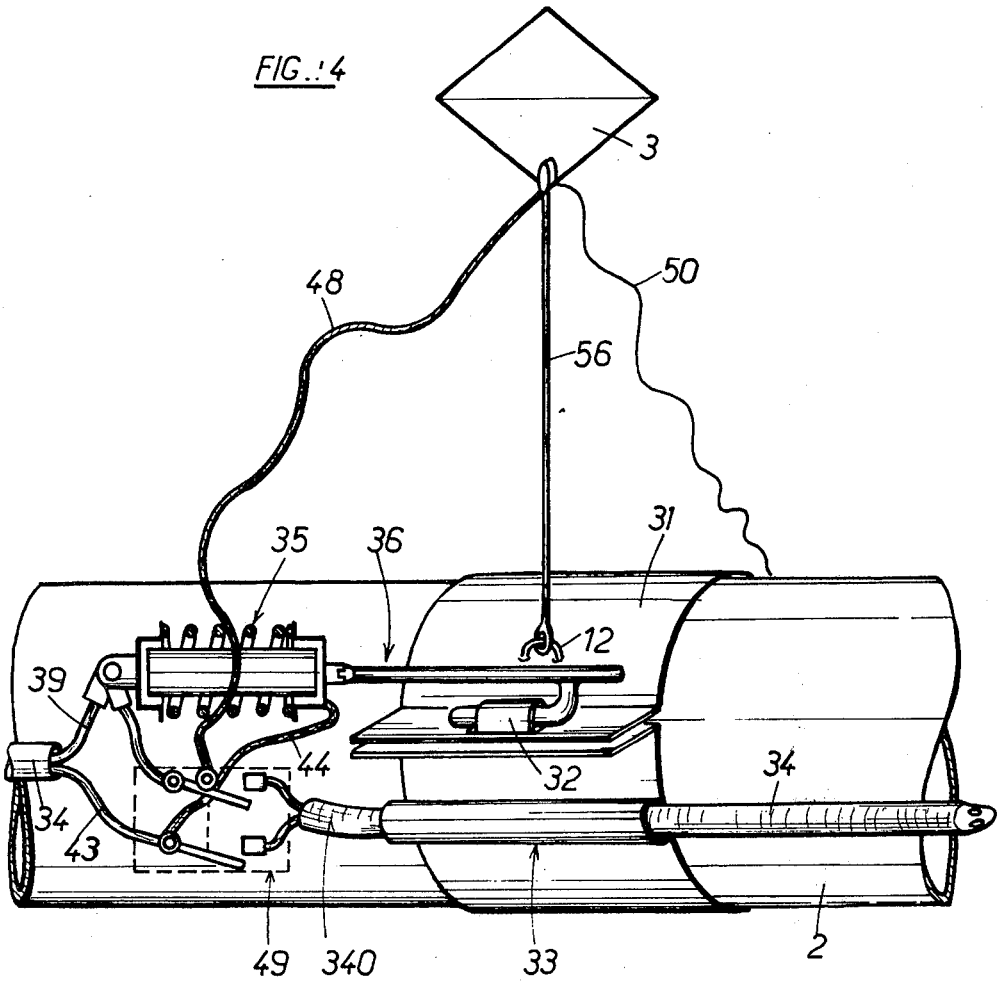
FIG. 4 shows a second embodiment, the liberating means being actuated electrically.

According to the second embodiment shown in FIG. 4, the liberating means of the floats are controlled electrically.

The float 3 is attached to the pipeline 2 by means of an articulated collar 31, provided with a ring 12, this assembly of collar and ring serving as attachment means to which is attached the suspender 56 of the float.

The collar 31 is kept closed by a sliding bolt 32. It has a boss 33 in which is engaged an electric cable 34 which the collar maintains in contact with the pipeline therealong.

Control of the opening of the collar, with the object of liberating the float 3, is effected by liberating means comprising a hammer 35 disposed coaxially with the control rod 36 for the sliding bolt.

This hammer comprises (FIG. 5) two parts, a fixed part or breech provided with an eyelet 38 which serves, on the one hand, to fix it to a convenient support and, on the other hand, to connect it electrically with one of the conductors 39 of the cable 34. The breech 37 is connected by a fusible member or link 40 to a mobile part or projectile 41, provided with a nose normally located in front of the control rod 36 and adapted to drive the latter.

The projectile 41 is connected electrically to the other conductor 43 of the cable 34 by a lead 44.

The breech and the projectile are engaged on the ends of a tubular insulating spacer 45 around which is wound a spring 46 maintained compressed between two insulating discs 47 via which it bears on the respective members.

When a current of sufficient intensity is passed along the cable 34, the link melts and the projectile 41, which is freed, acts on the control rod 36 to unbolt the collar 31.

The float, detached from the pipeline 2, escapes towards the surface. It is connected by a cord 48 to a connecting switch or commutation means 49 normally open which allows to be put into circuit a portion 340 of the cable 34 intended for controlling the release of the adjacent float (not shown). The cord 48 is adapted to break under the pull of the float once the switch 49 has been closed. The float could also be attached to a cord 50 enabling it to release a security control, for example by hydraulic or other means.

A cable with a single conductor could be used with a single control switch, the return of current being assured by the pipeline itself or even by the sea, by the use of an anode of zinc or other material ensuring the necessary electrical connection.

The cable could be omitted and the pipeline could be used as conductor of one pole with return to the other pole by the sea, but then it would necessary to provide a separate device for controlling the release of the following float.

A safety device could be ensured by incorporating an explosive bolt in the attachment device of the float and by controlling the explosion of this bolt by means of an electric signal which could be superimposed, in the cable 34, on the strong current used for fusing the link 40, and which would act upon an appropriate detector.

FIG. 6 shows a modification in which the suspender 51, which connects the float 3 to the pipeline 2, comprises such an explosive bolt 51.

The bolt is integral with a watertight box 52 containing an electric battery 53 and an electric control device 54 responsive to a hydrophone 55. When the hydrophone receives the desired acoustic signal, it causes the explosion of the bolt 51.

It is therefore to be understood that, within the scope of the appended claims, the invention may be practiced otherwise than as specifically described, without departing from the spirit and scope of the invention of which only the presently preferred embodiments have been disclosed.

We claim:

1. An installation for the release of a set of floats connected by individual cables to support a structure submerged in an aqueous medium, comprising a corresponding set of attachment means fixed on the structure and releasably holding one end of each said cable, the other end carrying the float, liberating means on said structure co-operating with each said attachment means for disconnecting therefrom the said one end of the cable held thereby, a release control station located a distance away from all said liberating means, a main connecting means connecting the control station to a first one of said liberating means, and a series of intermediate connecting means fixed on the structure connecting each said liberating means to another adjacent liberating means, said liberating means comprising two parts, a first part integral with the structure and a second part movable with respect to said structure and attachment means to remove floats in response to actuation from said release control station.

2. An installation according to claim 1, in which a safety device is located in parallel with the liberating means.

3. An installation according to claim 1, in which intermediate connecting means consist of fluid connections and the first part of said liberating means are fluidic devices operating successively under the effect of the supply of fluid to said connections.

4. An installation according to claim 1, in which the main control connecting means is a hydraulic pipe connecting the control station to the liberating means.

5. An installation according to claim 1, in which main control connecting means is an electrical connection controlling a fluid injection pump mounted on the structure for supplying at least one liberating means.

6. An installation according to claim 2, in which the safety device, located between two successive jacks, consists of a valve calibrated at a pressure which is a multiple of that provided for the normal functioning of the liberating means.

7. An installation according to claim 1, in which the main control connecting means and the intermediate connecting means are electric cables.

8. An installation according to claim 1, in which the first part of said liberating means comprises a fixed part, integral with the structure, a moving part located at one end of the fixed part, a spring housed between the fixed part and the moving part, a fusible member connecting said fixed part to said moving part and maintaining the spring compressed, said member being capable of melting when it is traversed by an electric current, the second part of said liberating means, fixed to the moving part, forming a sliding bolt.

9. An installation according to claim 8, in which the said attachment means consists of a collar closed by said bolt.

10. An installation according to claim 9, in which said intermediate connecting means formed by the electric cable are maintained on the structure by the collar.

11. An installation according to claim 7, in which the portion of the cable corresponding to the control of liberation of a float is connected to the portion used for controlling the liberation of the following float by commutation means comprising a connecting switch operated so as to be closed by the float when the latter is liberated.

12. An installation according to claim 11, in which the float is connected to the said connecting switch by a line adapted to be broken once the said switch has been closed.

13. An installation according to claim 1, in which the float is adapted to disengage a safety device when it is liberated.

14. An installation according to claim 13, in which the said safety device comprises an explosive bolt and an electric disengager associated with said bolt.

15. An installation according to claim 14, in which the end of the cable co-operating with said attachment means comprises in combination an explosive bolt, an electric disengager associated with the said explosive bolt, and a hydrophone controlling the said electric disengager.

16. An installation according to claim 1, in which each of said intermediate connecting means comprises a respective commutation means that at rest interrupts transmission of actuation from the control station to the following intermediate connecting means and establishes transmission of actuation thereto after release of the corresponding float from a connecting means thereby to successively release floats in said set.

17. An installation according to claim 16, in which said first parts of the liberating means consist of fluid-operated jacks, said second parts being formed by the piston stems co-operating with said attachment means, said commutation means being provided for each jack so as to control the jacks in succession.

18. An installation according to claim 17, in which the fluid supplying the jacks consists of the water which surrounds them, said jacks being formed with an opening communicating with the exterior.

* * * * *